United States Patent [19]

Stoll et al.

[11] 4,351,133

[45] Sep. 28, 1982

[54] ABRASIVE PAPER CONNECTION FOR USE ON AN OSCILLATING GRINDER

[76] Inventors: Kurt Stoll, Lenzhalde 72, 7300 Esslingen am Neckar; Dieter Tschacher, Hohenzollernstrasse 4, 7313 Reichenbach, both of Fed. Rep. of Germany

[21] Appl. No.: 169,322

[22] Filed: Jul. 16, 1980

[30] Foreign Application Priority Data

Jul. 21, 1979 [DE] Fed. Rep. of Germany ..... 2929618

[51] Int. Cl.[3] ..... B24B 23/04

[52] U.S. Cl. ..... 51/358; 51/170 TL; 15/231

[58] Field of Search ..... 51/57, 58, 59 R, 358, 51/372, 375, 382, 388, 391, 392, 393, 383, 386, 387, 170 MT, 170 TL; 15/231, 232; 101/415.1

[56] References Cited

U.S. PATENT DOCUMENTS

| | | | |
|---|---|---|---|
| 227,438 | 5/1880 | Lothrop | 51/392 X |
| 672,408 | 4/1901 | McAfee | 51/358 X |
| 1,122,640 | 12/1914 | Reed . | |
| 1,320,299 | 10/1919 | Wilson | 51/358 X |
| 2,124,220 | 7/1938 | Winston | 15/231 |
| 2,276,534 | 3/1942 | Burleigh | 51/170 MT |
| 2,438,977 | 4/1948 | Rosemeyer | 51/392 X |
| 3,014,316 | 12/1961 | Barnhart | 51/382 |
| 3,410,035 | 11/1968 | Gohde | 51/391 |
| 3,583,107 | 6/1971 | Benis | 51/382 X |

FOREIGN PATENT DOCUMENTS 2511392 9/1976 Fed. Rep. of Germany .

*Primary Examiner*—Stephen G. Kunin
*Assistant Examiner*—Robert P. Olszewski
*Attorney, Agent, or Firm*—Blanchard, Flynn, Thiel, Boutell & Tanis

[57] ABSTRACT

An abrasive paper connection for use on an oscillating grinder. At least one tensioning mechanism is provided on a table plate for effecting the connection of the abrasive paper to the table plate. The tensioning mechanism includes a clamping slide which is movably guided on the table plate and has an edge portion which effects a clamping of the abrasive paper between the edge portion and a portion of the table plate. An eccentric manually operated handle is provided which, when moved, effects a guiding movement of the clamping slide toward and away from the end surface.

11 Claims, 8 Drawing Figures

ABRASIVE PAPER CONNECTION FOR USE ON AN OSCILLATING GRINDER

FIELD OF THE INVENTION

The invention relates to an abrasive paper connection for use on an oscillating grinder having a table plate, which can be oscillated through a drive, and at least one tensioning device, with which an abrasive paper which is guided along the underside of the table plate can be fixed. The term "oscillatory" means hereinafter both a back and forth movement and also a socalled "orbital movement" and finally also an eccentric movement with an integrated circular movement.

BACKGROUND OF THE INVENTION

It is particularly simple in such oscillating grinders to design a tensioning device so that the abrasive paper can be inserted simply. In this connection it is for example known from German Offenlegungsschrift No. 25 11 392 to provide a clamping bar, which can be pivoted about an axis which extends parallel with respect to the upper side of the table plate and clamps with a free edge the abrasive paper against the upper side or the front surface of the table plate. Of course here too the threading of the abrasive paper and the operation of the tensioning device is complicated in comparison.

The purpose of the present invention is to further develop an abrasive paper connection for use on an oscillating grinder of the abovementioned type so that inserting the abrasive paper and operating the associated tensioning device is further simplified.

This purpose is attained inventively by the tensioning device including (a) a clamping slide, which is movably guided parallel to the upper side or to the underside of the table plate and has an edge, which can rest at least partially on an end surface of the table plate;

(b) an eccentric mechanism, which can be operated by hand and thereby effects a movement of the clamping slide.

Thus inventively the abrasive paper is no longer clamped on the upper side but on the end surfaces of the table plate. The part which effects the clamping moves thereby linearly, whereby the course of movement is determined by an eccentric mechanism.

The clamping slide is preferably made of flat spring steel.

It can include:

(a) a flat main surface, which rests on a support surface on the table plate;

(b) a V-shaped bent section which follows the flat main surface; and (c) an edge portion which follows the bent section and is bent back in direction of the front surface.

If at least two projecting teeth are provided on the edge portion, a still more reliable securing of the abrasive paper occurs, which paper has during tensioning the teeth extending therethrough. It is then favorable if bores are provided in the suitable end surface of the table plate, which bores receive the teeth in the closing position of the clamping slide.

At least two guide angle pieces can be arranged on both sides of the path of movement, which angle pieces laterally guide and grip over the clamping slide.

An eccentric mechanism is preferable which includes:

(a) a cylindrical guide surface on a locking handle which can be operated manually;

(b) a guide surface on the clamping slide, which guide surface is complementary with respect to the guide surface of the locking handle and which cooperates with the guide surface;

(c) an eccentric pin on the locking handle, the axis of which extends parallel and offset with respect to the axis of the guide surface on the locking handle;

(d) a slotted hole which is provided in the upper side of the table plate, which extends transversely with respect to the direction of movement of the clamping slide and in which the eccentric pin engages; and (e) a device which linearly guides the clamping slide.

The guide surface of the locking handle can be the surface of a cylindrical shoulder, wherein the guide surface of the clamping slide is a circular hole, into which the shoulder is guided. Yet more advantageous is it if the guide surface of the locking handle is formed by several cylindrical surface segments, which are distributed at a desired angular spacing on the shoulder of the locking handle and project outwardly from the surface thereof; also in this case the guide surface of the clamping slide is formed by a circular hole. This construction assures that the locking handle can be rotated easily with respect to the clamping slide.

Concentrically below the cylindrical surface segments of the locking handle can follow radially projecting, downwardly tapered, elastically deformable teeth. The teeth are compressed during the installation of the locking handle through the associated circular hole in the clamping slide, which causes the locking handle to be axially fixed on the clamping slide.

All together it is preferable to manufacture the locking handle of plastic.

BRIEF DESCRIPTION OF THE DRAWINGS

One exemplary embodiment of the invention will be discussed in greater detail hereinbelow with reference to the drawings, in which.

DETAILED DESCRIPTION

Figure 1:
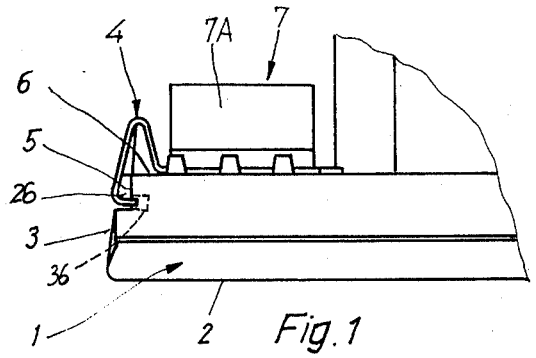
FIG. 1 schematically illustrates in a side view a portion of a table plate for an oscillating grinder embodying an inventive paper-tensioning device (closing position)
Figure 2:
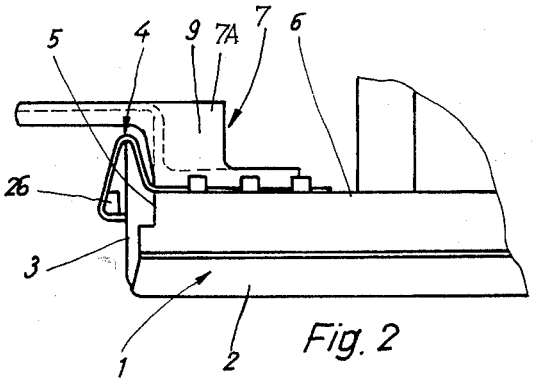
FIG. 2 is a view similar to FIG. 1, wherein the paper-tensioning device is in the open position.
Figure 3:
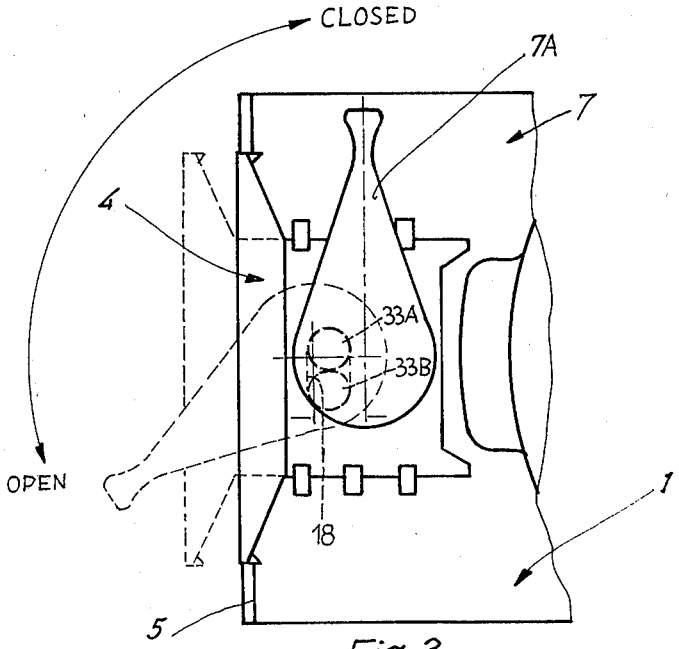
FIG. 3 is a top view of the table plate and the paper-tensioning device according to FIGS. 1 and 2.

FIGS. 1 to 3 provide the basis for a general explanation of the inventive paper-tensioning device. A description of the details will take place later on with reference to FIGS. 4 to 8. FIGS. 1 to 3 illustrate substantially one half of a table plate 1 of an oscillating grinder, which is connected in the usual manner to a motor so that it can oscillate. Along the underside 2 of the table plate 1 there is guided an abrasive paper 3, which is clamped in place by means of a clamping slide 4 against the end surfaces 5 of the table plate 1 and can thereby be tensioned or made taut.

The clamping slide 4 is guided for linear movement on the upper side 6 of the table plate 1. The clamping slide is movable by means of an eccentric lever mechanism 7 between an open position, to facilitate an insertion or removal of the abrasive paper 3 (FIG. 2 and FIG. 3 in broken lines), and a closing position in which the abrasive paper 3 is secured and tensioned or made taut (FIG. 1 and FIG. 3 in full lines). The eccentric mechanism 7 is operated through the structure of a locking handle 7A, which can be swung manually in direction of the double arrow which is shown in FIG. 3.

Figure 7:
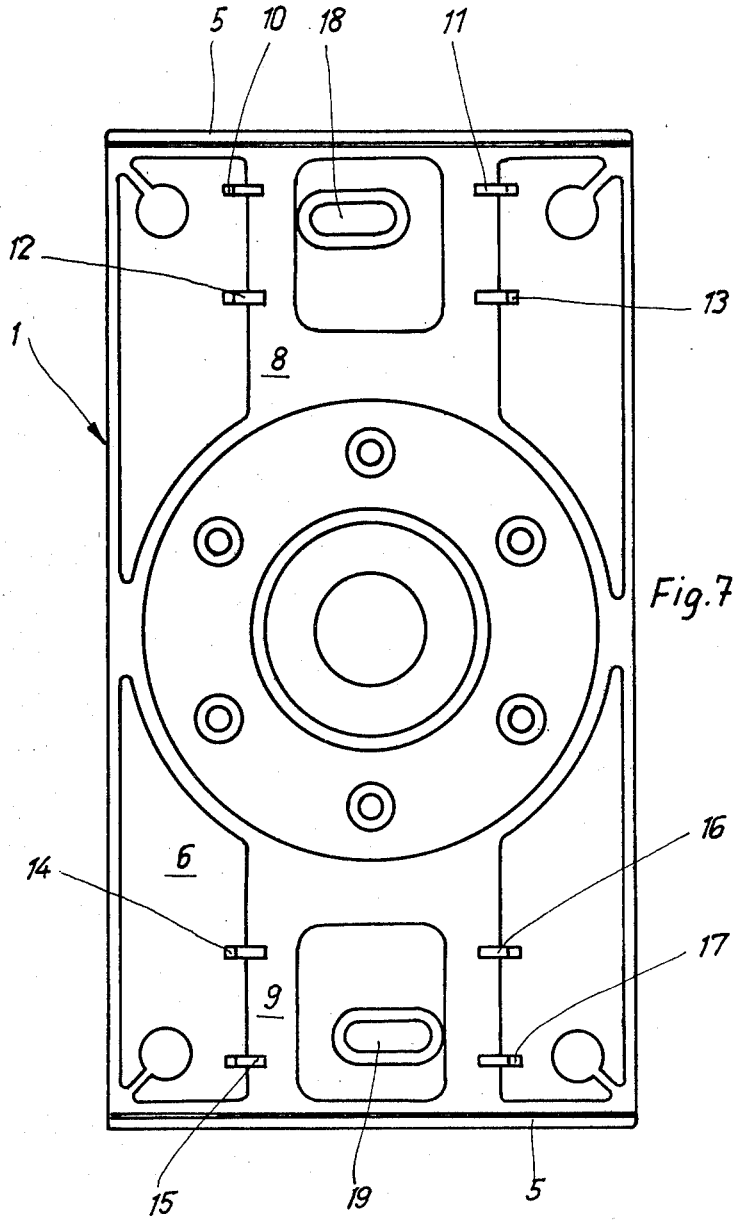
FIG. 7 is a top view of an inventive table plate when the clamping slides have been removed.

The detailed structure of the individual parts embodying the invention will now be discussed as follows:

As one can recognize from FIG. 7, the upper side 6 of the table plate 1 has on both ends a flat support surface 8 and 9, on which moves the associated one of the clamping slides 4. At least two angle pieces 10 to 17 (for example also three or four angle pieces as illustrated) are each arranged on the lateral boundary lines for the path of movement of the clamping slides 4 (compare also FIG. 8), which angle pieces grip over the clamping slide 4 and guide same (compare FIGS. 1 and 2).

A slotted hole 18 and 19 is formed in each of the two support surfaces 8 and 9. The longitudinal extent of each of the slotted holes extends transversely to the path of movement of the clamping slide 4. The eccentric mechanism 7 which moves the clamping slide 4 includes a part received in the appropriate slotted hole 18 or 19 in a manner which will yet be described.

Figure 5:
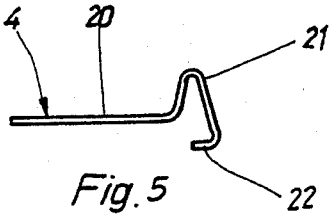
FIG. 5 is a side view of a clamping slide for use in the inventive paper-tensioning device.
Figure 6:
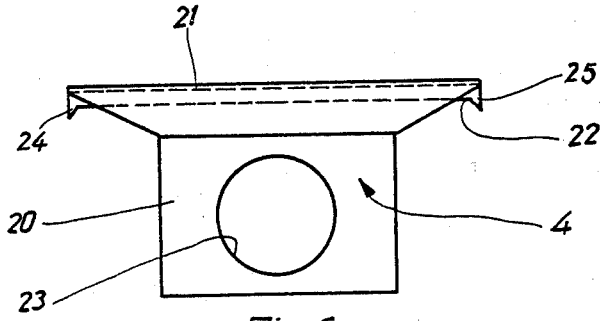
FIG. 6 is a top view of the clamping slide of FIG. 5.
Figure 8:
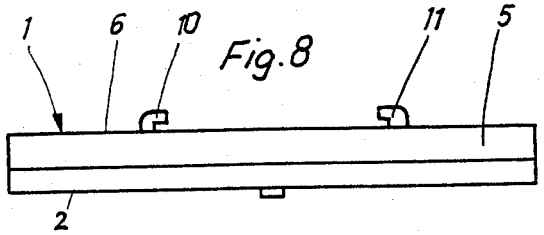
FIG. 8 is an end view of the table plate of FIG. 7.

The clamping slide 4 is illustrated in FIGS. 5 and 6. We here deal with a flat spring part having a flat main part 20, a V-shaped bent portion 21 which can be resiliently flexed and an edge portion 22 which is bent back so that it points toward the associated end surface 5 of the table plate 1 when the clamping slide 4 is mounted thereon. A circular hole 23 is provided in the flat main part and serves to receive a part of the locking handle 7A therein (see below).

The edge portion 22 is provided with two lateral, projecting teeth 24 and 25, which are adapted to penetrate through the abrasive paper 3 during a tensioning thereof and are received into bores 36 which are provided in the end surfaces 5 of the table plate 1. In addition the V-shaped bent portion 21 and the edge portion 22 enclose a tensioning bar 26 of rubber having a surface facing the end surface 5 which is parallel thereto and facilitates an exact securing of the abrasive paper 3 to the end surface 5 of the table plate 1. This securement is illustrated in FIGS. 1 and 2.

Figure 4:
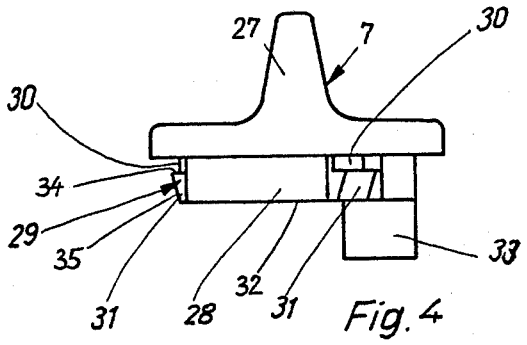
FIG. 4 is a side view of a locking handle for use in the inventive paper-tensioning device (enlarged scale)

The locking handle 7A is illustrated in FIG. 4. It is a plastic part having a handle 27 which extends upwardly from a cylindrical shoulder 28.

Several angularly spaced toothlike projections 29 are provided on the peripheral surface of the shoulder 28. Each of the projections 29 has two segments. A first of the two segments projects radially outwardly from the periphery of the cylindrical shoulder 28 and terminates in a cylindrical surface 30 having a diameter slightly greater than the diameter of the peripheral shoulder 28. The diameter of the surface 30 corresponds to the diameter of the hole 23 in the clamping slide 4. Immediately below the first segments is a second segment 31 having an upper part projecting radially outwardly beyond the cylindrical surface 30 to define an upwardly facing surface 34. The radially outwardly facing surface 35 is inclined to the vertical and slopes radially inwardly to a location spaced just slightly outwardly from the peripheral surface at the lower edge of the shoulder 28. The plural surfaces 35 define segments of a cone.

Finally an eccentric pin 33 is formed on and extends downwardly away from the underside 32 of the shoulder 28. The axis of the pin 33 extends parallel to the axis of the shoulder 28, however, offset with respect to the latter axis.

The described tensioning device is installed as follows:

First the clamping slide 4 is introduced with its flat main part 20 under the associated angle pieces 10 to 13 or 14 to 17, so that the edge portions 22 extend toward the suitable end surface 5 of the table plate 1. Then the shoulder 28 of the locking handle 7A is introduced under a light pressure into the circular hole 23 of the clamping slide 4. After a slight elastic deformation of the conical area 31 on the shoulder 28, the edges of the hole 23 on the clamping slide 4 engage the cylindrical surfaces 30.

During the introduction of the locking handle 7A into the hole 23 in the clamping slide 4, care is exercised to see that the eccentric pin 33 is received into the corresponding slotted hole 18 or 19 in the table plate 1. With this procedure, the tensioning device is installed.

As can be taken from FIGS. 1 to 2 and the above description, the reciprocal association of locking handle 7A, clamping slide 4, guide angle pieces 10 to 17 and slotted holes 18 or 19 is such that a rotation of the locking handle 7A causes a desired linear movement of the clamping slide 4. The locking handle 7A moves thereby along with the clamping slide 4; the eccentric pin 33 changes thereby its position within the slotted hole 18 or 19 between positions 33A and 33B shown in FIG. 3.

The described tensioning device is not only very simple to use; it can also be manufactured absolutely inexpensively.

During use, the power which is needed is much less than in conventional comparable arrangements. Furthermore, an important help during use results from the tensioning member automatically being stationary in the end position and not requiring to be held by hand as this has been the case up to now, which is a great advantage during insertion of abrasive paper.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an abrasive paper connection for use on an oscillating grinder having a table plate which has an end surface and can be moved by a drive mechanism, and having at least one tensioning device for securing an abrasive paper which is guided along the underside of the table plate, the improvement comprising wherein the tensioning device includes a clamping slide which is movably guided on the table plate and has an edge portion which can at least partially be applied against the end surface of the table plate, and includes a manually operable eccentric mechanism which controls movement of the clamping slide toward and away from the end surface, said eccentric mechanism including:

(a) a manually operable locking handle having a cylindrical guide surface thereon;

(b) a further guide surface on said clamping slide complementary to said guide surface on said locking handle and operatively associated therewith;

(c) an eccentric pin on said locking handle, the axis of which extends parallel and offset with respect to the axis of said guide surface on said locking handle;

(d) a slotted hole provided in the upper side of said table plate and extending transversely with respect to the direction of movement of said clamping slide, into which slotted hole extends said eccentric pin; and (e) a device, which linearly guides said clamping slide.

2. The abrasive paper connection for use on an oscillating grinder according to claim 1, wherein said guide surface on said locking handle is the surface of a cylindrical shoulder and wherein said guide surface on said clamping slide is a circular hole, into which is guided said shoulder.

3. The abrasive paper connection for use on an oscillating grinder according to claim 1, wherein said guide surface on said locking handle is formed by several cylindrical surface segments, which are angularly spaced around a shoulder on said locking handle and project radially outwardly therefrom, and wherein said guide surface on said clamping slide is formed by a circular hole.

4. The abrasive paper connection for use on an oscillating grinder according to claim 3, wherein radially projecting, downwardly tapered, elastically deformable teeth follow concentrically downwardly said cylindrical surface segments on said locking handle and form a step therewith.

5. The abrasive paper connection for use on an oscillating grinder according to one of the claims 1 to 4, wherein said locking handle is made of an elastomeric material having an elastically deformable characteristic.

6. The abrasive paper connection for use on an oscillating grinder according to claim 5, wherein said locking handle consists of plastic.

7. In a grinding machine which includes a plate having a clamping mechanism for an abrasive paper which rests on the underside of said plate, said clamping mechanism including two clamping slide members which are guided on an upper side of said plate for substantially parallel and rectilinear movement, which each have an edge which can at least partially engage an end surface of said plate, and which can be moved by means of an eccentric member which has a hand lever and has a cylindrical guide surface, the improvement comprising a separate said eccentric member associated with each said clamping slide member, each said cylindrical guide surface being an outer surface which engages a complementary guide surface on said clamping slide member associated therewith and each said eccentric member having thereon a pin, the axis of which extends parallel to and is offset with respect to the axis of said cylindrical guide surface, each said pin engaging a respective slotted hole provided in said upper side of said plate and extending transversely to the direction of movement of said associated clamping slide member.

8. The grinding machine according to claim 7, wherein said guide surface is defined by several angularly spaced partial cylinder surfaces which are provided on a shoulder of said eccentric member and project beyond the outer surface of said shoulder.

9. The grinding machine according to claim 8, including steplike, radially projecting, downwardly tapered end elastically deformable teeth provided on said eccentric member which are concentric to and axially spaced from the partial cylinder surfaces.

10. The grinding machine according to claim 9, wherein said eccentric member is made of plastic.

11. A mechanism for releasably connecting an abrasive paper on a grinder having a table plate and having an end surface on said table plate, comprising:

a clamping member supported on said table plate for substantially rectilinear movement in a first direction between first and second positions, said clamping member having at least one surface thereon which presses a portion of said abrasive paper against said end surface of said table plate when said clamping member is in said first position;

a manually operable member rotatably supported on said clamping member for movement between third and fourth positions about an axis substantially perpendicular to said first direction and having a pin which is spaced from and is substantially parallel to said axis; and means defining a slot in said table plate which extends substantially transversely to said first direction, said pin being slidably received in said slot;

whereby rotational movement of said manually operable member about said axis effects movement of said clamping member between said first and second positions.

* * * * *

UNITED STATES PATENT AND TRADEMARK OFFICE

CERTIFICATE OF CORRECTION

PATENT NO. : 4 351 133

DATED : September 28, 1982

INVENTOR(S) : Kurt Stoll and Dieter Tschacher

It is certified that error appears in the above—identified patent and that said Letters Patent is hereby corrected as shown below:

Col. 6, line 21; change "end" to ---and---.

Signed and Sealed this

*Twenty-second* Day of *February 1983*

[SEAL]

*Attest:*

GERALD J. MOSSINGHOFF

*Attesting Officer* *Commissioner of Patents and Trademarks*